US005533560A

United States Patent [19]

Morris

[11] Patent Number: 5,533,560

[45] Date of Patent: Jul. 9, 1996

[54] VENETIAN BLIND HEADRAIL AND MOUNTING BRACKET SYSTEM

[75] Inventor: John E. Morris, Lake Mills, Wis.

[73] Assignee: Springs Window Fashions Division, Inc., Middleton, Wis.

[21] Appl. No.: 321,962

[22] Filed: Oct. 11, 1994

[51] Int. Cl.[6] ..... E06B 9/38

[52] U.S. Cl. ..... 160/178.1; 160/902

[58] Field of Search ..... 160/902, 168.1 R, 160/176.1 R, 178.1 R, 178.1 V, 177 R; 16/94 R; 248/254, 262

[56] References Cited

U.S. PATENT DOCUMENTS

| | | | |
|---|---|---|---|
| 2,698,727 | 1/1955 | Rutledge . | |
| 3,169,006 | 2/1965 | Lorentzen et al. . | |
| 4,235,406 | 11/1980 | Vecchiarelli . | |
| 4,406,435 | 9/1983 | Anderson . | |
| 4,802,644 | 2/1989 | Oskam . | |
| 4,919,185 | 4/1990 | Comeau et al. . | |
| 4,938,443 | 7/1990 | Rowe | 160/902 X |
| 5,074,350 | 12/1991 | Carton | 160/902 X |
| 5,180,130 | 1/1993 | McMichael . | |

*Primary Examiner*—Blair Johnson
*Attorney, Agent, or Firm*—Vernon J. Pillote

[57] ABSTRACT

A venetian blind headrail and bracket system in which the headrail has a downwardly extending light block panel along a rear edge of the bottom wall, a front upper rim on the front wall and a rear upper rim on the rear wall. The mounting bracket includes an upwardly opening front notch for receiving a lower edge of the front upper rim and a downwardly opening rear notch spaced rearwardly from the front notch for receiving the rear upper rim, and a support ledge spaced below the rear notch for engaging a lower edge of the light block panel to support the headrail in a mounted position on the bracket with a clearance between the rear upper rim and the base of the rear notch. The rear notch has a width sufficiently less than the outer width of the rear upper rim to have an interference fit therewith when the headrail is in the mounted position on the bracket.

15 Claims, 2 Drawing Sheets

VENETIAN BLIND HEADRAIL AND MOUNTING BRACKET SYSTEM

BACKGROUND OF THE INVENTION

Venetian blind headrails are commonly in the form of a channel shaped rail closed at the bottom, front and rear and open at the top, and which it receives the venetian blind operating mechanism including the slat support and tilt mechanism and the lift cord guide and lock mechanism. Many different venetian blind headrail and mounting systems have been proposed for mounting the headrail on walls or overhead surfaces. Some headrail mounting brackets are suitable for use only at the ends of the headrail and some others are arranged for supporting the headrail and different positions along its length.

It is an object of the present invention to provide an improved venetian blind headrail and mounting bracket system that is arranged to support the headrail at different positions along the length of the headrail and which is simple to install, which firmly supports the headrail against not only the downward loads on the headrail due to the weight of the blind and the forces exerted on the headrail by the lift and operating cords, but which also anchors the headrail against endwise movement, and which minimizes light passage between the upper slat and the headrail when the venetian blind is closed.

Accordingly, the present invention provides a venetian blind headrail and bracket system in which the headrail has a bottom wall, a downwardly extending light block panel along a rear edge of the bottom wall, a rear wall and a front wall, the front wall having a rearwardly and downwardly extending front upper rim and the rear wall having a forwardly and downwardly extending rear upper rim, the rear upper rim having an upper surface spaced a preselected distance from the lower edge of the light block panel. The mounting bracket includes a rear plate and an upper plate extending forwardly from an upper edge of the rear plate, the bracket having a forwardly opening front notch means located forwardly of a front edge of the upper plate for receiving a lower edge of the front upper rim, and a depending flange on the upper plate has a downwardly opening rear notch means spaced rearwardly from the front notch means for receiving the rear upper rim. Support means on the mounting bracket includes a ledge portion spaced below a base edge of the rear notch means a distance sufficiently greater than the spacing of the upper rim from the lower edge of the light block panel for engaging a lower edge of the light block panel to support the headrail in a mounted position on the bracket while there is a clearance between the rear upper rim and the base edge of the rear notch means. The front edge of the rear notch means is spaced from the opposed rear edge a distance sufficiently less than the outer width of the rear upper rim to have an interference fit therewith when the headrail is in the mounted position on the bracket.

DETAILED DESCRIPTION

Figure 1:
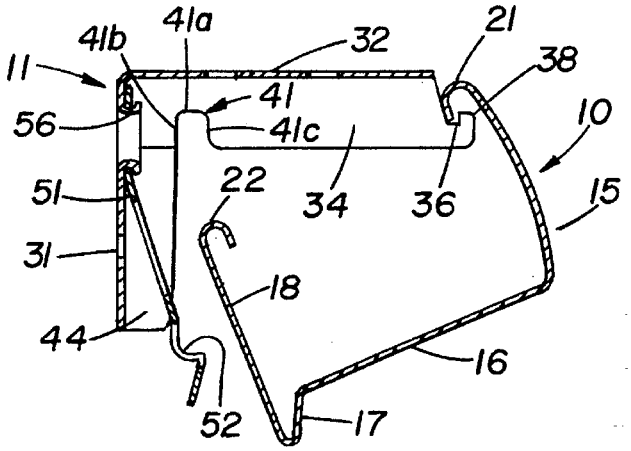
FIG. 1 is a vertical sectional view through the headrail and mounting bracket illustrating mounting of the headrail on the bracket.
Figure 2:
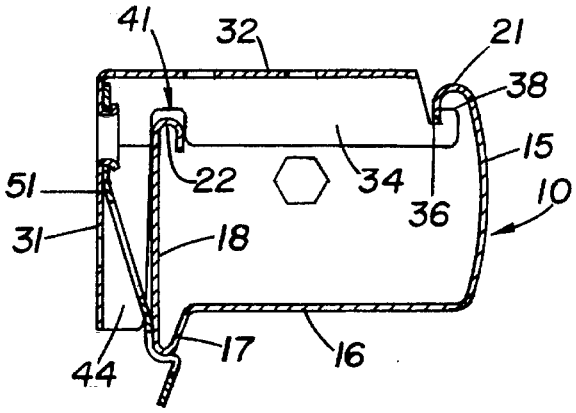
FIG. 2 is a vertical sectional view through the headrail and mounting bracket illustrating the headrail in a mounted position on the bracket.
Figure 3:
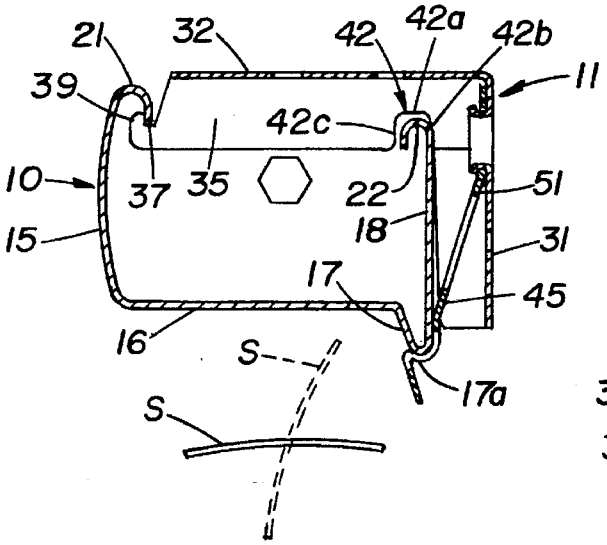
FIG. 3 is a vertical sectional view illustrating a side of the bracket opposite that shown in FIGS. 1 and 2.
Figure 4:
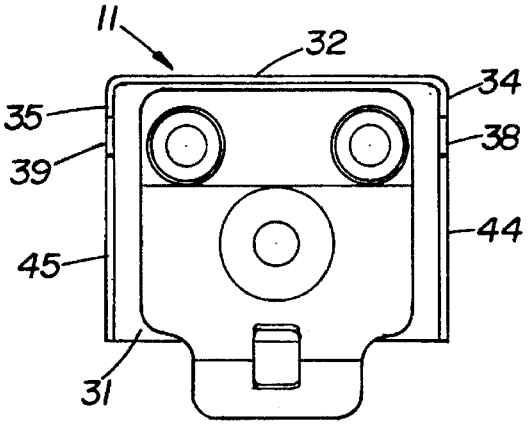
FIG. 4 is a vertical sectional view taken on the plane 4—4 of FIG. 1.

Referring now more specifically to the drawings, there is illustrated a venetian blind headrail 10 and mounting bracket 11 for mounting the headrail at locations intermediate the ends of the headrail. The headrail includes a front wall 15, a bottom wall 16, a light block panel 17 and a rear wall 18. The front wall 15 has a rearwardly and downwardly extending front upper rim 21 and the rear wall 18 has a forwardly and downwardly extending rear upper rim 22. In the preferred embodiment illustrated, the headrail is roll formed from a strip of sheet metal with the light block panel 17 extending downwardly from a rear edge of the bottom wall 16 and with the rear wall extending upwardly from a lower edge of the light block panel means. The light block panel extends below the bottom wall a distance such that the upper edge of the upper slat S of the venetian blind (FIG. 3) extends above a horizontal plane through the lower edge 17*a* of the light block panel, when the headrail is mounted on the brackets and the upper slat is in its closed position as shown in phantom in FIG. 3.

In the preferred embodiment illustrated, the mounting bracket 11 includes a rear plate 31 and an upper plate 32 extending forwardly from an upper edge of the rear plate. Fastener receiving openings are provided in the rear and front plates of the brackets for use in mounting the brackets on upright and/or horizontal surfaces. The upper plate has depending side flanges 34, 35 along opposite sides. The depending side flanges extend from the rear wall to a location forwardly of the front edge of the upper plate 32, and the side flanges 34 and 35 have upwardly opening notches 36 and 37, respectively disposed forwardly of the forward edge of the top wall for receiving a lower edge of the front upper rim 21 on the headrail. The notches 36 and 37 provide upwardly extending fingers 38, 39 on the forward ends of the flanges 34, 35 and which fingers project upwardly into the upper front rim of the headrail. The flanges 34, 35 are also formed with downwardly opening rear notches 41, 42 spaced rearwardly from the front notches 36, 37. Rear notch 41 has a base edge 41*a* and opposed rear and front edges 41*b*, 41*c* and rear notch 42 has a base edge 42*a* and opposed rear and front edges 42*b* and 42*c* extending downwardly from the base edge.

The rear plate 31 has forwardly extending side flanges 44, 45, the forward edges of which are arranged to guide the upper edge of the rear wall of the headrail into the notches 41 and 42. As shown, the forward edges of the flanges 45 and 46 are substantially aligned with the rear edges 41*b*, 42*b*, respectively of the rear notches in flanges 34, 35. Preferably, the forward edges of flanges 44 and 45 are inclined at a shallow angle, for example of the order of two degrees upwardly and forwardly relative to the rear plate to guide the upper edge of the rear wall of the headrail upwardly and forwardly into the rear notches.

Support means are provided on the bracket for engaging the lower edge of the light block panel to support the head rail in a mounted position on the bracket. In the embodiment of FIGS. 1–6, the support means includes a leaf spring 51 mounted on the rear plate 31 adjacent the upper end of the latter, and which leaf spring extends downwardly and has a support ledge 52 adjacent its lower end for engaging the lower edge 17*a* of the light block panel. The leaf spring 51 is conveniently mounted on the rear plate of the bracket by forming openings in rear plate with inwardly projecting bosses 56 around the openings dimensioned to be received in corresponding openings in the spring member 51, and then staking or riveting the bosses over the spring member to hold the spring member firmly against the rear plate.

The brackets are arranged to firmly support the headrail against the downward loads imposed by the weight of the blind and forces exerted on the lift cords and operating cords during operation of the blind, and to also lock the headrail against endwise movement relative to the brackets. For this purpose, the distance designated Hr in FIG. 6 between the upper surface of the rear upper rail 22 and the lower edge 17*a* of the light block panel is maintained within predetermined tolerances during forming of the headrail, and the support ledge 52 on the bracket is spaced a distance designated Hb in FIG. 5 which is sufficiently greater than the distance designated Hr in FIG. 6 such that the ledge 52 can engage the lower ledge of the light block panel to support the headrail in a mounted position on the bracket, with a clearance between the rear upper rim 22 and the base edges 41*a*, 42*a* of the rear notch means 41 and 42. In order to constrain the headrail against vertical movement and also against lengthwise movement, the front edge of at least one rear notch is spaced from the opposed rear edge of that notch a distance sufficiently less than the outer width of the rear upper rim on the headrail to have an interference fit therewith when the headrail is in the mounted position on the bracket. More specifically, the rear upper rim 22 on the headrail is formed with an outer width measured perpendicular to the rear wall and designated Wr in FIG. 6 and the forward edge 42*c* on one rear notch 42 is spaced on the opposed rear edge of the notch a distance designated Wb in FIG. 5, that is sufficiently less than the outer width Wr to have an interference fit with the rear upper rim when the rear wall of the headrail is pressed upwardly into the notches. While the forward edges of both of the notches can be formed to provide an interference fit with the rear upper rim, it has been found that providing interference fit between one rear notch and the rim is sufficient, while reducing the force required to move the rear portion of the headrail upwardly into a mounted position with the rear upper rim in the notches.

Figure 5:
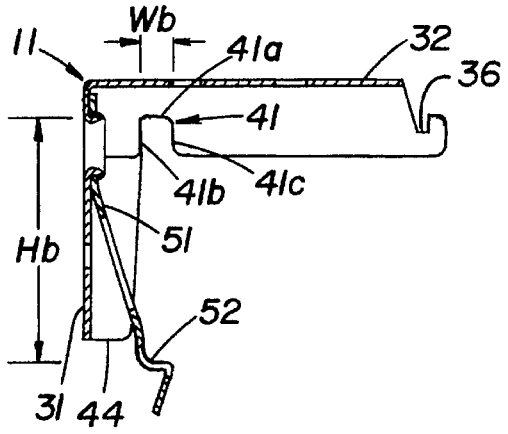
FIG. 5 is a front view of the mounting bracket.
Figure 6:
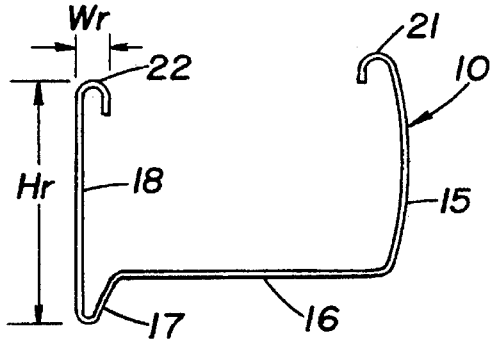
FIG. 6 is a vertical sectional view through the headrail.
Figure 7:
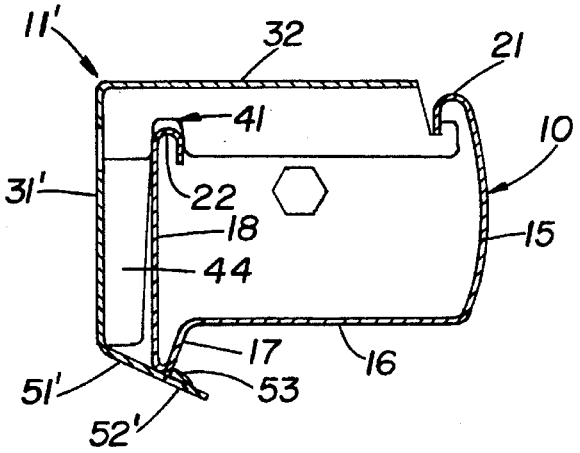
FIG. 7 is a vertical sectional view through a headrail and mounting bracket illustrating a modified form of mounting bracket.
Figure 8:
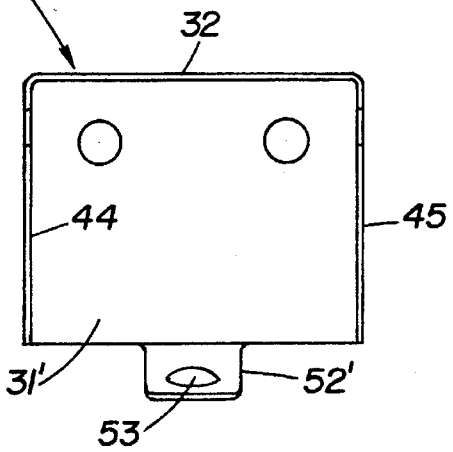
FIG. 8 is a front view of the mounted bracket 6 of FIG. 7.

FIGS. 5 and 6 illustrate a mounting bracket having a modified support member. The bracket in this embodiment is similar to that shown in FIGS. 1–5 and like numerals are used to designate the same parts and like numerals with the postscript ' used to designate modified parts. In FIGS. 7 and 8, the headrail support member 51' and ledge 52' are formed integrally with the rear plate 31' and extend forwardly therefrom to underlie the lower edge 17*a* of the light block panel, when the headrail is in the mounted position on the bracket. A means such as a nose or protuberance 53 may be formed in the ledge 52' at a location to engage the front side of the light block panel, when the headrail is in its mounted position.

From the foregoing it is believed the construction and mounting of the headrail and bracket assembly will be readily understood. The upper and rear plates of the bracket have fastener receiving openings to allow the bracket to be mounted either on upright surface or on a horizontal overhead, such as the underside of the a window frame. The headrail with the venetian blind assembled thereon can then be mounted on the brackets by positioning the front upper rim in the notches 21*a* in the brackets and adjusting the headrail longitudinally to the desired position relative to the brackets. The rear portion of the headrail can then be pivoted upwardly about the forward rim until the upper rear rim enters the rear notches 41 and 42 in the bracket. The forwardly extending flanges on the rear plate of the bracket aid in guiding the upper edge of the rear wall into the notches 41, 42. As previously described, at least one of the notches such as 42 is arranged to have an interference fit with the rear upper rim on the headrail. The interference fit only moderately increases the force which must be applied by hand to push the rear of the headrail into a seated position and the pressure applying area provided by the downwardly extending light block panel aids in pressing the headrail into position.

The embodiments of the invention in which an exclusive property or privilege is claimed are defined as follows:

1. A venetian blind headrail and bracket system comprising, (a) an elongate headrail including a bottom wall, light block panel means extending downwardly and rearwardly along a rear edge of the bottom wall, a rear wall, and a front wall, the front wall having a rearwardly and downwardly extending front upper rim and the rear wall having a forwardly and downwardly extending rear upper rim, the rear upper rim having an upper surface spaced a preselected distance from a lower edge of the light block panel means, (b) at least one mounting bracket, each mounting bracket including a rear plate and an upper plate extending forwardly from an upper edge of the rear plate, the bracket having upwardly opening front notch means located forwardly of a front edge of the upper plate for receiving a lower edge of the front upper rim, a depending flange on the upper plate having a downwardly opening rear notch means spaced rearwardly of the front notch means for receiving the rear upper rim, the downwardly opening rear notch means having a base edge and opposed rear and front edges, support means on the mounting bracket including a ledge portion spaced below the base edge of the rear notch means a distance greater than said preselected distance and such that the ledge portion can engage the lower edge of the light block panel means to support the headrail in a mounted position on the bracket with a clearance between the rear upper rim and the base edge of the rear notch means, the rear upper rim having an outer width measured perpendicular to the rear wall, the front edge of the rear notch means being spaced from the opposed rear edge of the rear notch means a distance sufficiently less than the outer width of the rear upper rim to have an interference fit therewith when the headrail is in the mounted position on the bracket.

2. A venetian blind headrail and bracket system according to claim 1 wherein the rear plate has means for guiding the rear upper rim into the rear notch means.

3. A venetian blind headrail and bracket system according to claim 1 wherein the flange on the top plate has said front notch means therein.

4. A venetian blind headrail and bracket system according to claim 1 wherein said front upper rim is disposed forwardly of said top plate when the headrail is in the mounted position.

5. A venetian blind headrail and bracket system according to claim 4 wherein the front upper rim is disposed at a level above the level of the rear upper rim when the headrail is in the mounted position.

6. A venetian blind headrail and bracket system according to claim 1 wherein the support means comprises a spring member affixed adjacent an upper end to the rear plate, the spring member extending downwardly and forwardly and having said ledge portion adjacent a lower end for engaging the lower edge of the light block panel means.

7. A venetian blind headrail and bracket system according to claim 1 wherein said support means and ledge portion are integral with said rear plate.

8. A venetian blind headrail and bracket system comprising, (a) an elongate headrail including a bottom wall light block panel means extending downwardly and rearwardly along a rear edge of the bottom wall, a rear wall extending upwardly from a lower edge of the light block panel means, and a front wall extending upwardly from a forward edge of the bottom wall, the front wall having a rearwardly and downwardly extending front upper rim and the rear wall having a forwardly and downwardly extending rear upper rim, the rear upper rim having an upper surface spaced a preselected distance from the lower edge of the light block panel means, (b) at least one mounting bracket, each mounting bracket including a rear plate and an upper plate extending forwardly from an upper edge of the rear plate, the upper plate having depending side flanges, the side flanges each having upwardly opening front notch means located forwardly of a front edge of the upper plate for receiving a lower edge of the front upper rim, the depending side flanges each having a downwardly opening rear notch means spaced rearwardly of the front notch means for receiving the rear upper rim, the downwardly opening rear notch means each having a base edge and opposed rear and front edges extending downwardly from the base edge, support means on the mounting bracket including a ledge portion spaced below the base edge of the rear notch means a distance greater than said preselected distance and such that the ledge portion can engage the lower edge of the light block panel means with a clearance between the rear upper rim and the base edge of the rear notch means, to support the headrail at the rear of the latter in a mounted position on the bracket, the rear upper rim having an outer width measured perpendicular to the rear wall, the front edge of at least one of the rear notch means being spaced from the opposed rear edge of said one rear notch means a distance sufficiently less than the outer width of the rear upper rim to have an interference fit therewith when the headrail is in the mounted position on the bracket.

9. A venetian blind headrail and bracket system according to claim 8 wherein the rear plate has side flanges and forward edges on the side flanges arranged to guide the rear upper rim into the rear notch means.

10. A venetian blind headrail and bracket system according to claim 9 wherein the forward edges on the side flanges on the rear plate are inclined forwardly and upwardly relative to the rear plate.

11. A venetian blind headrail and bracket system according to claim 8 wherein said front upper rim is disposed forwardly of said top plate when the headrail is in the mounted position.

12. A venetian blind headrail and bracket system according to claim 11 wherein the front upper rim is disposed at a level above the level of the rear upper rim when the headrail is in the mounted position.

13. A venetian blind headrail and bracket system according to claim 8 wherein the support means comprises a spring member affixed adjacent an upper end to the rear plate and extending downwardly and forwardly and having said ledge portion adjacent a lower end for engaging the lower edge of the light block panel means.

14. A venetian blind headrail and bracket system according to claim 8 wherein said headrail is formed of sheet metal.

15. A venetian blind headrail according to claim 8 wherein the support means and ledge portion are integral with said rear plate.

* * * * *